United States Patent [19]

Link

[11] 3,956,721

[45] May 11, 1976

[54] FAULT INTERRUPTER

[75] Inventor: Edwin A. Link, Waukesha, Wis.

[73] Assignee: RTE Corporation, Waukesha, Wis.

[22] Filed: Apr. 16, 1975

[21] Appl. No.: 568,721

[52] U.S. Cl. ..... 335/6; 200/144 B; 335/189

[51] Int. Cl.[2] ..... H01H 33/66

[58] Field of Search ..... 335/6, 189, 27, 62, 335/190, 191, 151; 200/144 B

[56] References Cited

UNITED STATES PATENTS

| | | | |
|---|---|---|---|
| 2,922,011 | 1/1960 | Mitchell | 335/189 |
| 3,597,556 | 8/1971 | Sharp | 200/144 B |
| 3,823,288 | 7/1974 | Wilson | 200/144 B |
| 3,898,407 | 8/1975 | Hodgson | 200/144 B |

*Primary Examiner*—Harold Broome
*Attorney, Agent, or Firm*—Ronald E. Barry

[57] ABSTRACT

A high voltage fault interrupter including a vacuum interrupter having a fixed contact and a movable contact, a trip mechanism module connected to said movable contact, said trip mechanism module monitoring the power line for conditions which call for circuit interruption, a dielectric housing completely enclosing said interrupter and said trip mechanism module, the housing including a flexible dielectric interface, and an actuating and reset module connected to said trip mechanism module through the flexible dielectric interface. The trip mechanism module can include contact position and fault condition indicators within the dielectric housing which are visible externally to indicate the condition of the interrupter. The high voltage interrupter can include a hydraulic interphase trip module which is responsive to fault opening of the vacuum interrupter for providing a hydraulic pulse to a second and third circuit interrupter connected in the same system.

22 Claims, 13 Drawing Figures

FAULT INTERRUPTER

BACKGROUND OF THE INVENTION

In my earlier copending application Ser. No. 257,165, filed May 26, 1972 and entitled "Modular Circuit Interrupting Device", a high voltage interrupter was disclosed which included a flexible insulating diaphragm to insulate the manual actuator from the live voltage of the interrupter. In my U.S. Pat. No. 3,755,714, issued on Aug. 28, 1973 and entitled "A Fault Locating and Isolating System for an Electric Power Distribution System", a completely enclosed circuit breaker having the trip mechanism within the circuit breaker and at line voltage is disclosed.

SUMMARY OF THE INVENTION

The high voltage interrupter of the present invention provides for the encapsulation of a vacuum circuit interrupter and a trip mechanism module within a dielectric housing so that all of the trip functions will be located on the high potential side of the housing. The trip mechanism module is operable through a flexible interface thus eliminating the necessity for physically large dielectric isolation members. The trip module can include fault tripped indicators and contact position indicators. The circuit interrupter is designed to be incorporated within a three phase system with interphase trip modules provided in each high voltage interrupter, the interphase trip modules being hydraulically actuated which provides excellent insulation between the trip mechanism on the three interrupters which are at full potential on each of the lines. The interphase trip modules can also be actuated externally to produce a pulse of hydraulic pressure anywhere in the interphase trip system to trip all of the interrupters.

Drawings

Description of the Invention

Figure 1:
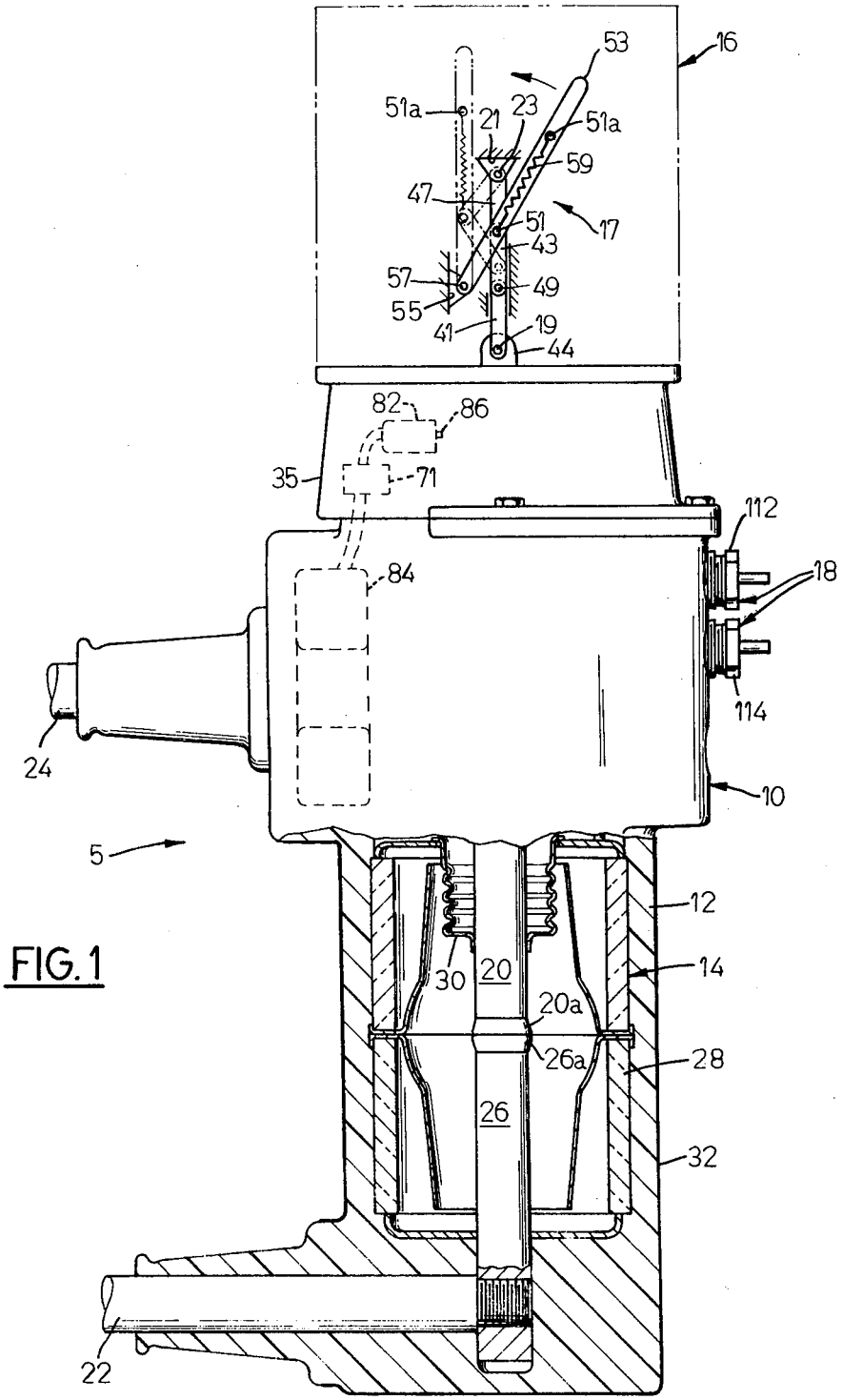
FIG. 1 is a side view partly in section generally showing the arrangement of the high voltage fault interrupter of the present invention.

The high voltage fault interrupter 5 of the present invention generally includes a trip mechanism module 10, a vacuum type circuit interrupter 14, a manual actuate and reset module 16 and an interphase module 18. The trip mechanism module 10 and circuit interrupter 14 as seen in FIG. 1 are enclosed within a dielectric housing 12. The trip mechanism module 10 is actuated or reset by means of the actuate and reset module 16 through a flexible interface 34 generally shown mounted on the end of the housing 12. The trip mechanism module 10 monitors the power line for conditions which call for circuit interruption. The tripping movement of one of the trip mechanism modules 10 in a three pole arrangement, is transmitted hydraulically to the other two fault interrupters by means of the hydraulic interphase module 18 provided in each of the fault interrupters 5.

Vacuum Circuit Interrupter (FIGS. 1–5)

More particularly, the circuit interrupter 14 includes a movable rod 20 having a contact 20*a* and a fixed rod having a contact 26*a* for connecting high voltage conductors 22 and 24. The vacuum circuit interrupter 14 is of a conventional type including a housing 28 having the fixed rod 26 supported at one end and connected to the high voltage conductor 22 and the movable rod 20 mounted in the other end of the housing 28 and supported for axial movement by means of a bellows 30. The movable rod 20 is electrically connected to the high voltage conductor 24 by means of a connector clamp 25 and a flexible conductor 27.

The circuit interrupter 14 is housed within the insulating housing 12 which also partially encloses the trip mechanism module 10. The open end of the housing 12 is closed by means of the flexible dielectric interface 34 which is sealed to the housing 12 by an end cap 35. The housing 12 is grounded by means of a conductive coating 32 provided on the outer surface of the housing 12 and the outer surface of the interface 34. The trip mechanism module 10 is thus located on the high potential side of the flexible interface 34 and the reset module 16 is located on the ground potential side of the flexible interface 34. Although the housing 12 has been indicated as being formed of a dielectric material with a conductive coating 32 on the outer surface, it should be understood that the vacuum interrupter could be housed within a metallic electrically conductive housing having a flexible dielectric section at one end with a dielectric medium filling the space between the vacuum interrupter and the metallic housing.

Means are provided on the end of the movable rod 20 for biasing the contact 20*a* to an open position. Such means is in the form of a compression spring 46 mounted around the rod 20 between the end of the guide bearing 13 and the clamp 25. Means are provided on the end of rod 20 for maintaining a minimum contact pressure between contacts 20*a* and 26*a*. Such means is in the form of a spring retainer ring 29 and a second spring 48 provided on the end of the rod 20. The spring retainer 29 is retained on the end of the contact rod 20 by a bolt 33. The spring 48 is positioned between the contact ring 25 and the retainer ring 29 to provide a lost motion connection between the trip module 10 and the rod 20 which compensates for any attrition of the contacts 20*a* and 26*a*. A pair of slots 39 are provided on the end of the retainer ring 29.

The Actuate and Reset Module 16

The trip mechanism module 10 can be manually actuated or reset by means of the module 16. As seen in FIG. 1, the module 16 is in the form of a releasable or collapsible linkage assembly 17 having one end operatively connected to an insulating member 44 by a pin 19 and the other end connected to a fixed support 21 by a pin 23. The insulating member 44 is embedded in the interface 34 and includes a notch 45 on the high potential side of the interface 34.

The linkage assembly 17 is shown in the form of a toggle including three links 41, 43 and 47 connected by pins 49 and 51. The linkage assembly 17 is actuated or tripped by means of a handle 53 connected in a fixed support 55 by pin 57. The linkage assembly 17, as shown in solid lines in FIG. 1, is biased to the closed position by means of a spring 59 having one end connected to pin 51 and the other end to a pin 51*a* in the upper part of handle 53. The linkage assembly is opened by rotating the handle 53 anticlockwise on pin 57 until pin 51*a* falls in alignment with pins 51 and 23. Further motion overcenters the linkage assembly 17 to the position shown phantomed in FIG. 1. The spring 59 will hold the links 43 and 47 in the open position. Subsequent manual clockwise rotation of handle 53 past the point of alignment of pins 51*a*, 23 and 51 will bias linkage assembly 17 back into the closed position.

The Trip Mechanism Module 10

Figure 2:
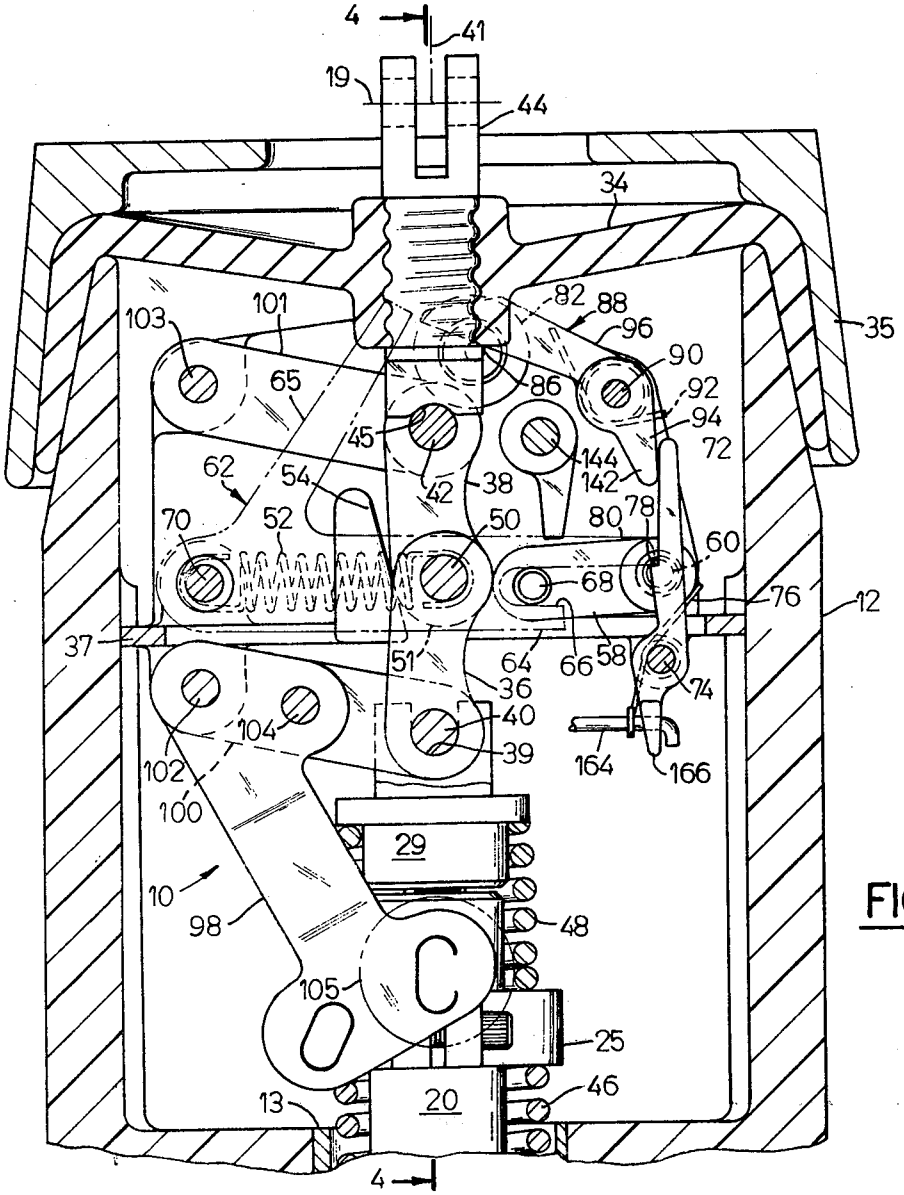
FIG. 2 is a view in section of the trip mechanism module according to the invention shown in the closed mode.
Figures 4, 5, 13:
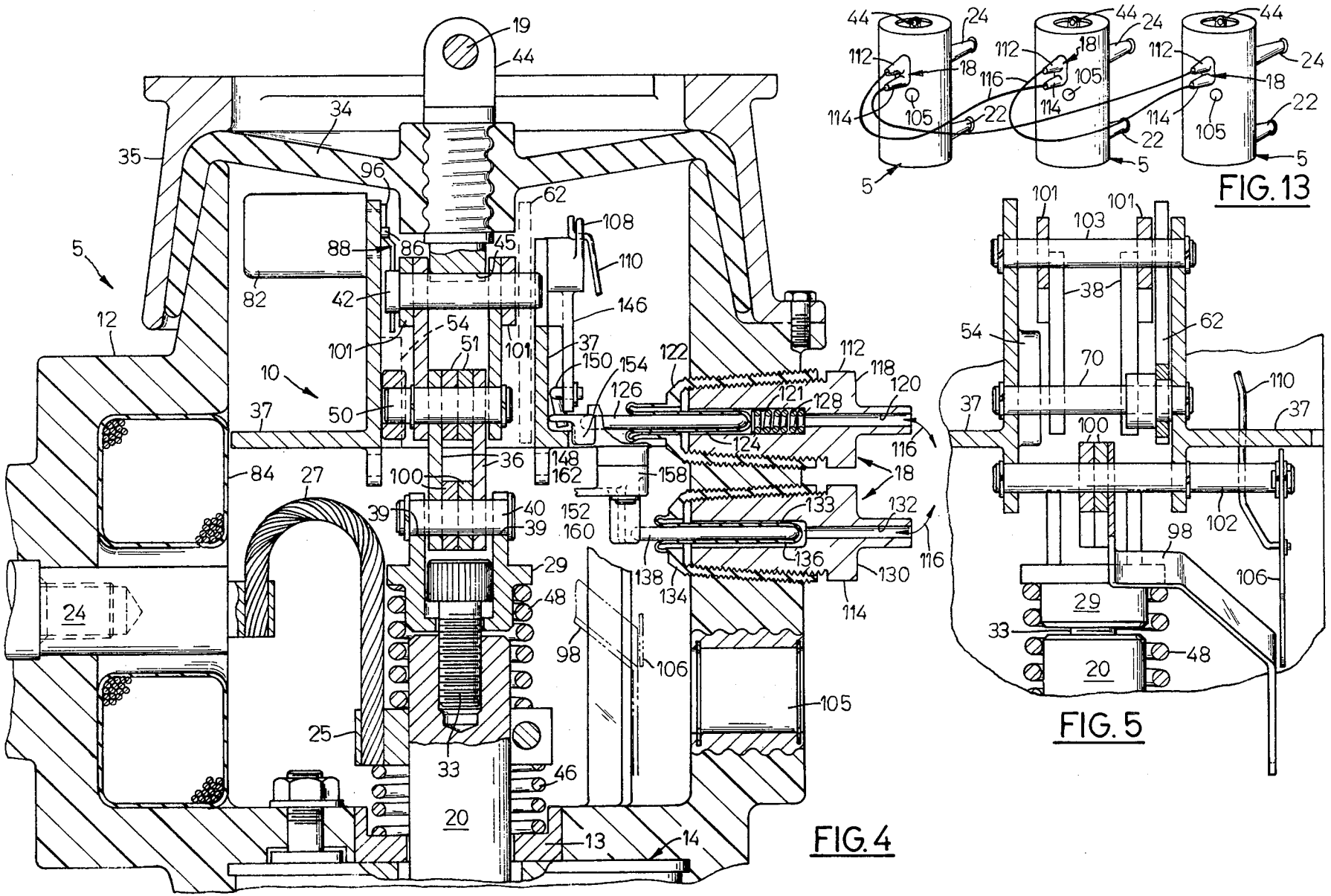
FIG. 4 is a view taken on line 4—4 of FIG. 2 showing the trip mechanism in the closed mode.
FIG. 5 is a view taken on line 5—5 of FIG. 3 showing the fault and trip flag linkage.
FIG. 13 is a schematic type perspective view of three fault interrupters according to the invention interconnected by interphase trip modules to form a three pole switching structure.

Referring to FIGS. 2 and 4, the trip mechanism module 10 is shown connected between the movable rod 20 of the circuit interrupter 14 and the insulating member 44 in the flexible dielectric interface 34. In this regard, the trip mechanism module 10 includes a support frame 37 having two pair of support links 100 and 101, respectively, mounted for pivotal movement on pins 102 and 103 in frame 37. A first pair of actuating links 36 are pivotally connected to a pin 40 on the end of the support links 100. A second pair of actuating links 38 are pivotally connected to a pin 42 on the end of the support links 101. The links 36 and 38 are interconnected by means of a pin 50. One or a pair of rollers can be provided on pin 50 between links 36.

The links 36 and 38 are positioned between the rod 20 and insulating member 44 by positioning the pin 40 into the slots 39 in the retainer ring 29 and the pin 42 in the notch 45 in member 44. The links 36 and 38 are moved to an in-line position to close the contact 20*a* against contact 26*a* and are allowed to collapse to move the contact 20*a* away from the contact 26*a*. The links 36 and 38 are held in the in-line position by means of a suicide catch or link 58 which is pivotally mounted on a pin 60 in frame 37 and retained in a support position by means of a bell crank 62 and a trip lever 72.

In this regard, the bell crank 62 is pivotally mounted on a pin 70 in frame 37 and includes a first arm 64 and a second arm 65. The first arm 64 includes a slot 66 and an extension 80. The latch 58 includes a pin 68 which extends beyond the latch 58 into the slot 66 in the bell crank 62.

The bell crank 62 is used to rotate the latch 58 to the holding position with respect to the links 36 and 38. In the holding position the links 36 and 38 will be offcenter and the bias force of the springs 46 and 48 will act through the rollers 51 against the cam surface 57 of latch 58 tending to rotate the latch 58 in a counterclockwise direction to collapse the links 36 and 38.

The bell crank 62 is prevented from rotating by means of the trip lever 72 which is pivotally mounted on a pin 74 in frame 37 and biased by means of a spring 76 in a counterclockwise direction. The trip lever 72 includes a notch 78 which is located in a position to engage the end of the extension 80 on the first arm 64 of the bell crank 62. It should be noted that the force of the spring 46 and 48 acting through the links 36 and 38 on rollers 51 against the latch 58 will tend to rotate the bell crank 62 in a clockwise direction about the pin 70. The trip lever 72 prevents rotation of the bell crank and as more particularly described hereinafter, pivotal movement of the trip lever 72 will release the notch 78 from the end of the extension 80 on the bell crank 62 allowing the bell crank 62 to pivot freely in a clockwise direction about the pin 70. Since the latch 58 will also be released, the force of the springs 46 and 48 will collapse the links 36 and 38 opening the circuit interrupter 14.

The trip module 10 continuously monitors the power line for conditions which call for circuit interruption. In this description, an electronic trip control 71 is described. However, a magnetic control can also be used. The electric signal for tripping the trip mechanism module 10 is generated by means of a current transformer 84 mounted in the housing 12 around the high voltage conductor 24. Under fault current conditions the current generated in the transformer 84 will energize a solenoid 82 through trip control 71 to release an actuating lever 88 that is used to trip lever 72.

In this regard, the actuating lever 88 is mounted on a pin 90 which is pivotally mounted in frame 37. The lever 88 is biased by means of a spring 92 in a clockwise direction with the outer end 96 of the actuating lever 88 biased into engagement with the plunger 86 of the solenoid 82. The trip lever 72 is tripped by means of a trip arm 94 mounted on pin 90.

Figure 6:
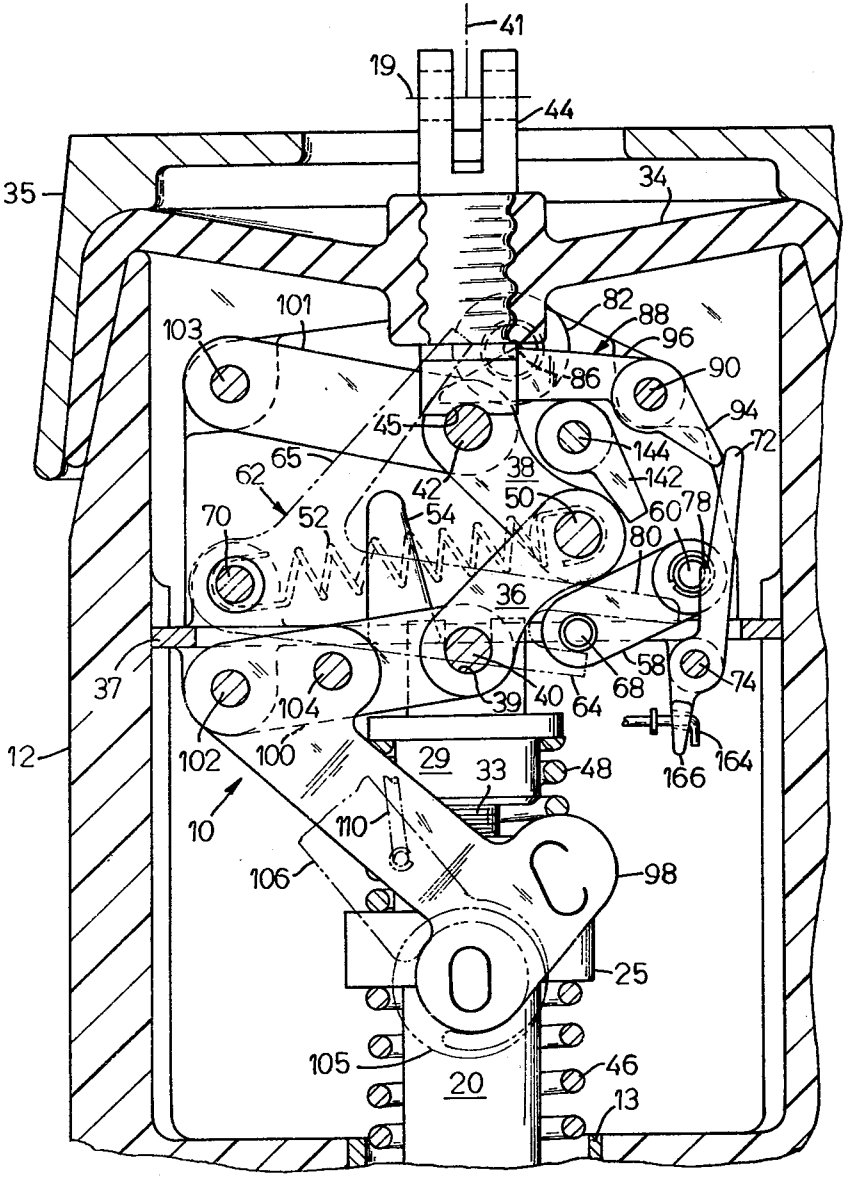
FIG. 6 is a view similar to FIG. 2 showing the trip mechanism in the fault trip mode.

When the solenoid 82 is energized, the plunger 86 will be retracted allowing the actuating lever 88 to pivot the pin 90. The rotary motion of pin 90 will rotate arm 94 into engagement with the trip lever 72. As seen in FIG. 6, the movement of the trip lever 72 releases the notch 78 from the end 80 of the bell crank 62 allowing the links 36 and 38 to collapse due to the bias of the springs 46 and 48. Collapse of the links 36 and 38 will pivot the latch 58 about the pivot pin 60.

Resetting the Fault Interrupter

Figure 8:
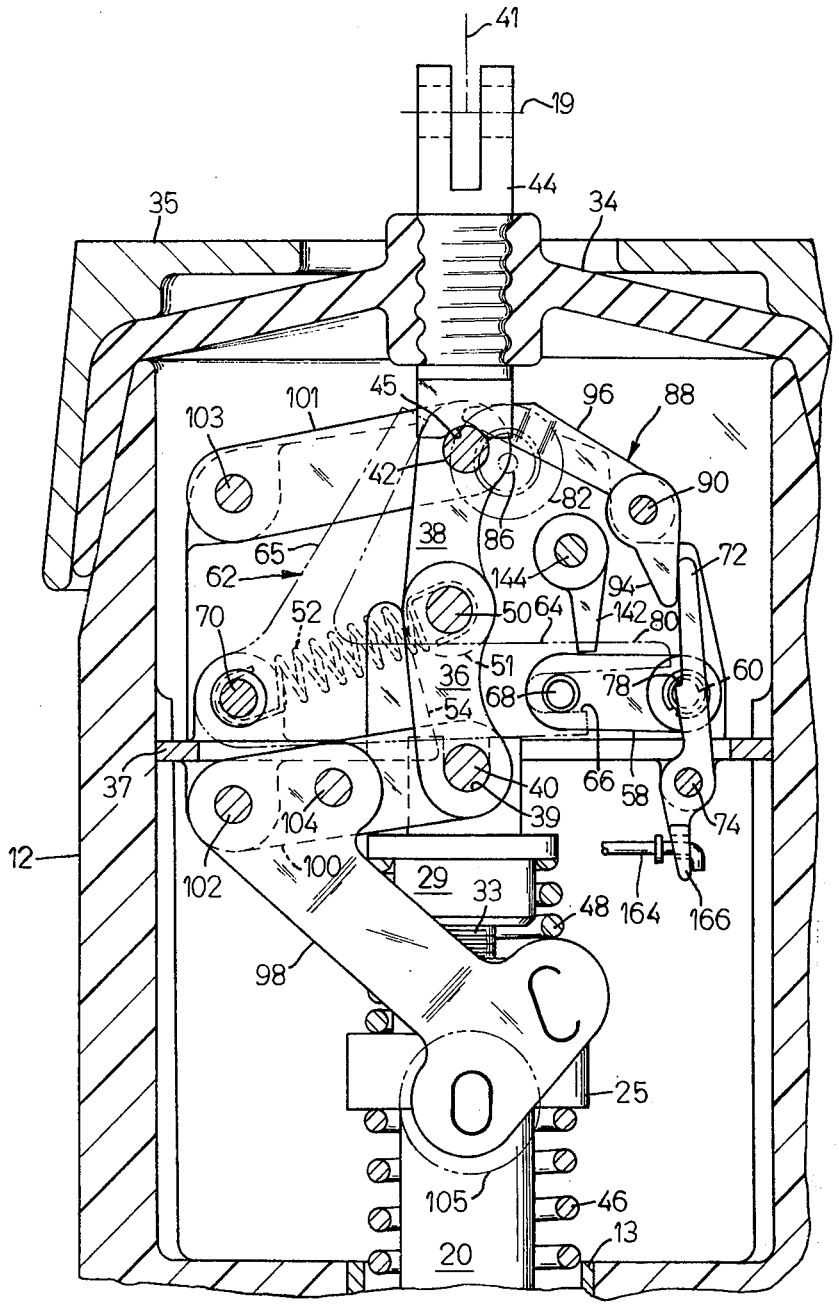
FIG. 8 is a view similar to FIG. 2 showing the trip mechanism module in position for manual reset.

The circuit interrupter 14 is reset by means of the reset module 16 which is connected to the insulating member 44 in the flexible interface 34. Reset of the circuit interrupter 14 is accomplished by moving the member 44 away from the circuit interrupter 14 to allow spring 52 connected between pin 50 and pin 70 to pull the links 36 and 38 into an in-line position as shown in FIG. 8. The cam roller 49 on the end of the center pin 50 will be pulled into engagement with a fixed cam 54 provided on frame 37. The links 36 and 38 will then be in an overcenter relation with respect to a line drawn through the axis of the pins 40 and 42. Simultaneously as the links 36 and 38 are pulled away from the circuit interrupter 14, the bell crank 62 and the actuating lever 88 will be reset.

In this regard and referring to FIG. 8, it will be noted that the actuating lever 88 extends into the path of motion of the end of the pin 42. On movement of the pin 42 away from the rod 20, the actuating lever 88 will be rotated clockwise against the bias of the spring 92 past the plunger 86 of the solenoid 82. The trip lever 72 will follow the movement of the arm 94 due to the bias of the spring 76 (FIG. 2 only). Simultaneously with the resetting of the trip lever 72, the end of the link 38 will engage the arm 65 of the bell crank 62 pivoting the bell crank 62 counterclockwise about the pin 70. The counterclockwise movement of the bell crank 62 will pivot the catch or link 68 about the pin 60 due to the engagement of the pin 68 with the slot 66 in the bell crank 62. The lower end 80 of the bell crank will be pivoted beyond the notch 78 in the trip lever 72.

The circuit temperature 14 is closed by rotating the handle 53 in the module 16 clockwise to push the member 44 toward the circuit interrupter 14. The links 38 and 36 will move with the insulating member 44 against the bias of the springs 46 and 48 to close the contact 20*a* with the contact 26*a*. Since the links 36 and 38 are overcenter, the cam follower 49 on the end of the pin 50 will ride on the surface of the cam 54 until the rollers 51 engage the end of the latch 58. The movement of the cam follower 49 will move the pin 50 overcenter as the roller 51 engages the latch 58 so that the full bias force of the springs 46 and 48 will act on the end of the latch 58.

Contact Position Indicator

Figure 3:
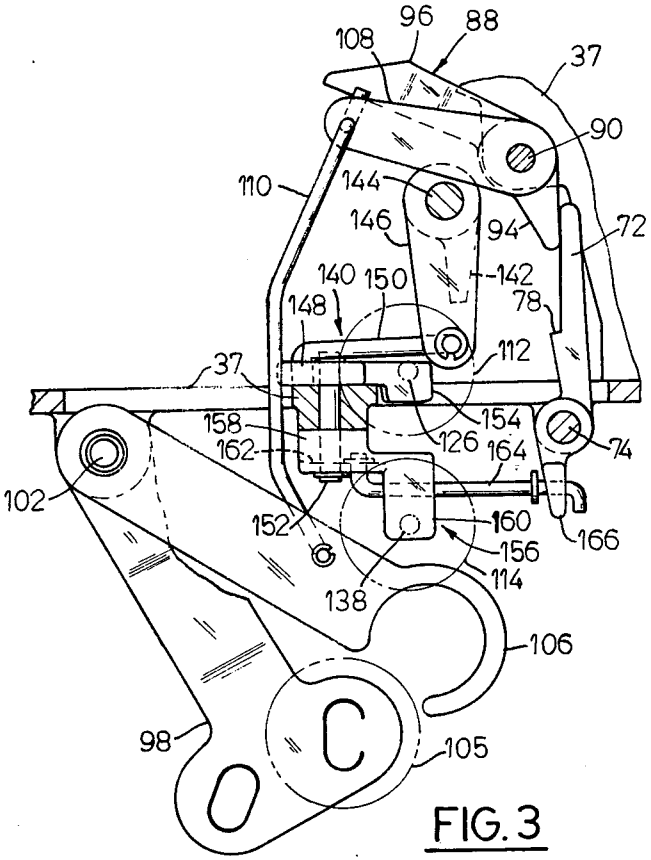
FIG. 3 is a view of the linkage for the fault and trip flags for the trip mechanism module.
Figure 7:
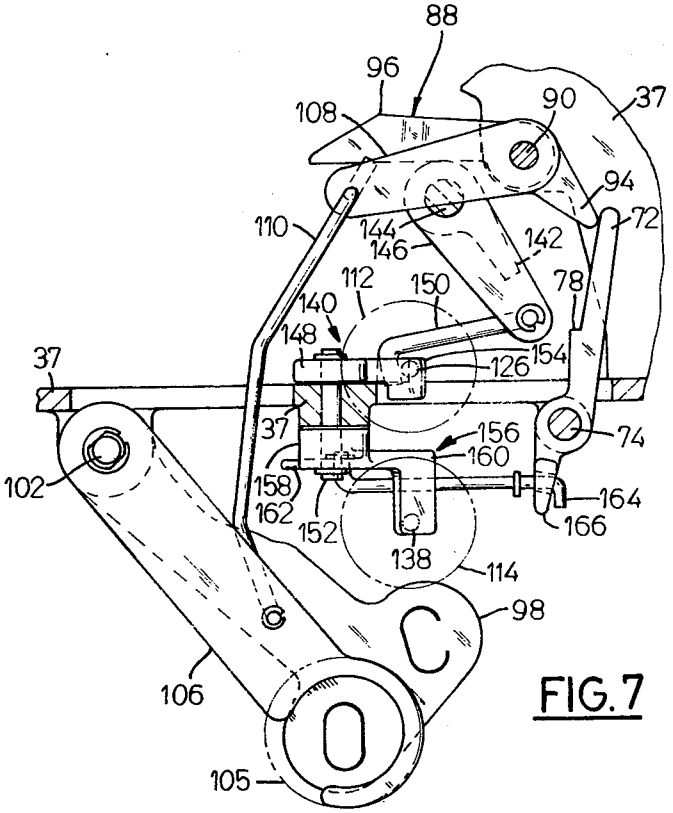
FIG. 7 is a view similar to FIG. 3 showing the fault and trip flags in the fault trip mode.

Means are provided within the housing 12 for indicating the position of the contact 20*a*, i.e. opened or closed, with respect to the contact 26*a*. Such means, as seen in FIGS. 3 and 7, is in the form of a flag 98 that responds to the movement of the rod 20. The flag 98 is connected to the link 100 by means of pins 102 and 104. The link 100 as indicated above is connected to the pivot pin 40 and rotates about the pin 102. When the contact 20*a* is in the closed position, the flag will be located in a position to expose a letter C etched on the end of the flag 98 through a transparent section of the housing or a window 105 provided in the wall of the housing 12. When the contact 20 moves to the open position, as seen in FIG. 6, the link 100 will pivot about the pin 102 moving the flag 98 with respect to the window 105 until a letter O etched on the flag is visible through the window 105.

Fault Trip Indicator Module

Figure 10:
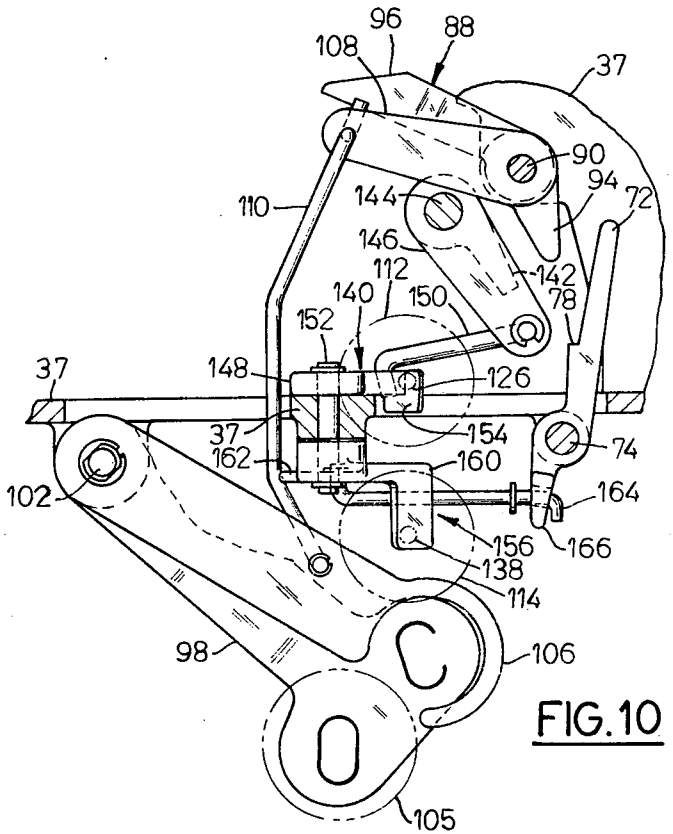
FIG. 10 is a view similar to FIG. 3 showing the fault and trip flags in the interphase trip mode.
Figure 9:
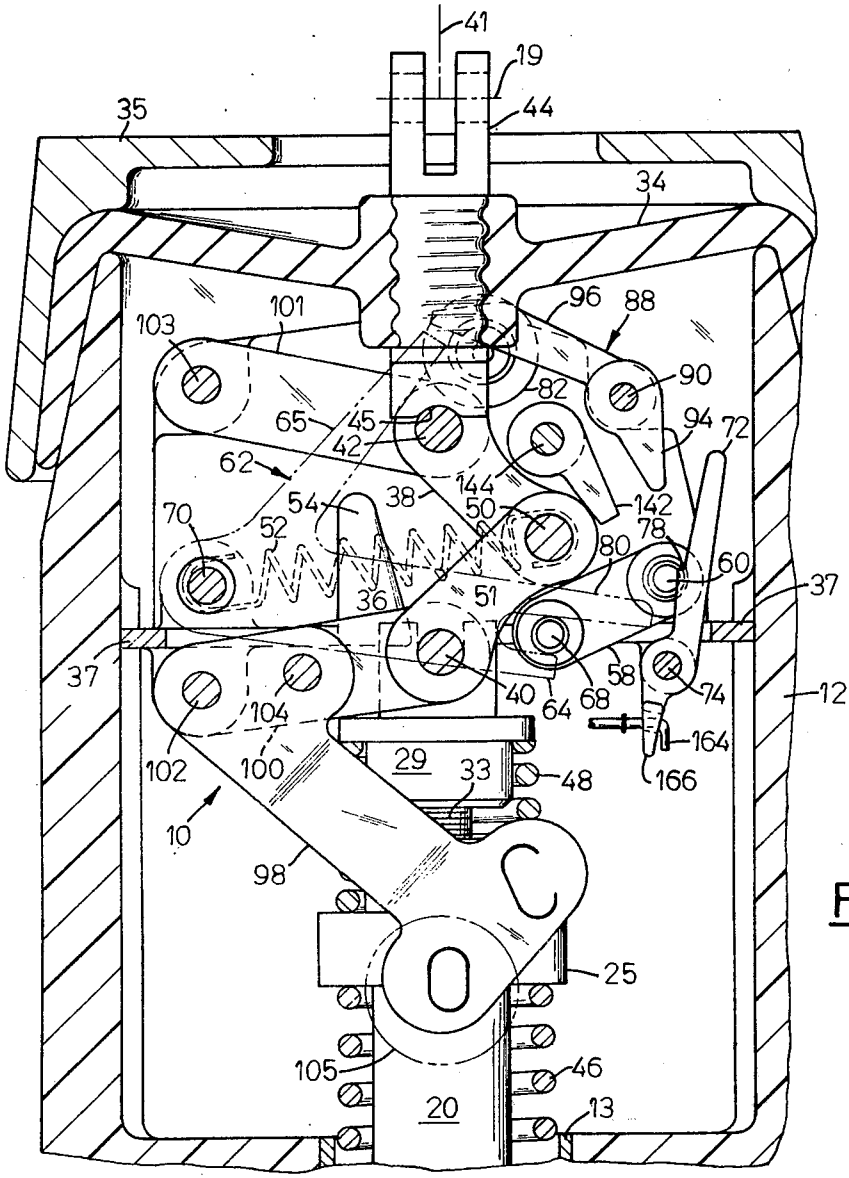
FIG. 9 is a view similar to FIG. 2 showing the trip mechanism module in the interphase trip mode.

Means are provided within the housing 12 to indicate that the contact is open as a result of a fault trip. A fault trip condition is indicated by means of a second flag 106 which is also pivotally mounted on the pin 102. The flag 106 moves in response to the pivotal movement of the actuating lever 88. This is accomplished by means of a link 108 which is secured to the pivot pin 90 and connected to the flag 106 by means of an actuating arm 110 as seen in FIGS. 7 and 10. Under a fault trip condition the actuating lever 88 will pivot the pin 90 in a counterclockwise direction pushing the actuator arm 110 against the flag 106 and pivoting the flag 106 about the pin 102 until the end of the flag 106 is visible in the window 105. If the circuit interrupter is opened, either manually or by an interphase trip, the flag 106 will be in the position shown in FIGS. 3 and 10.

Interphase Trip Module for Three-Phase System

Each fault interrupter 5 can be provided with means for hydraulically tripping all of the fault interrupters in a three phase system in the event one of the three interrupters is tripped. This is accomplished by means of the hydraulic interphase trip modules 18 which automatically respond to the tripping or opening of any one of the three interrupters in the system to automatically trip the other two interrupters.

As seen in FIG. 13, each fault interrupter 5 in the three phase system is provided with an interphase trip module 18. Each interphase trip module 18 includes an interphase transmitter 112 and an interphase receiver 114. The interphase transmitter 112 in each module 18 is hydraulically connected by lines 116 to the interphase receiver 114 of one of the other fault interrupters 5 in the system.

Figure 12:
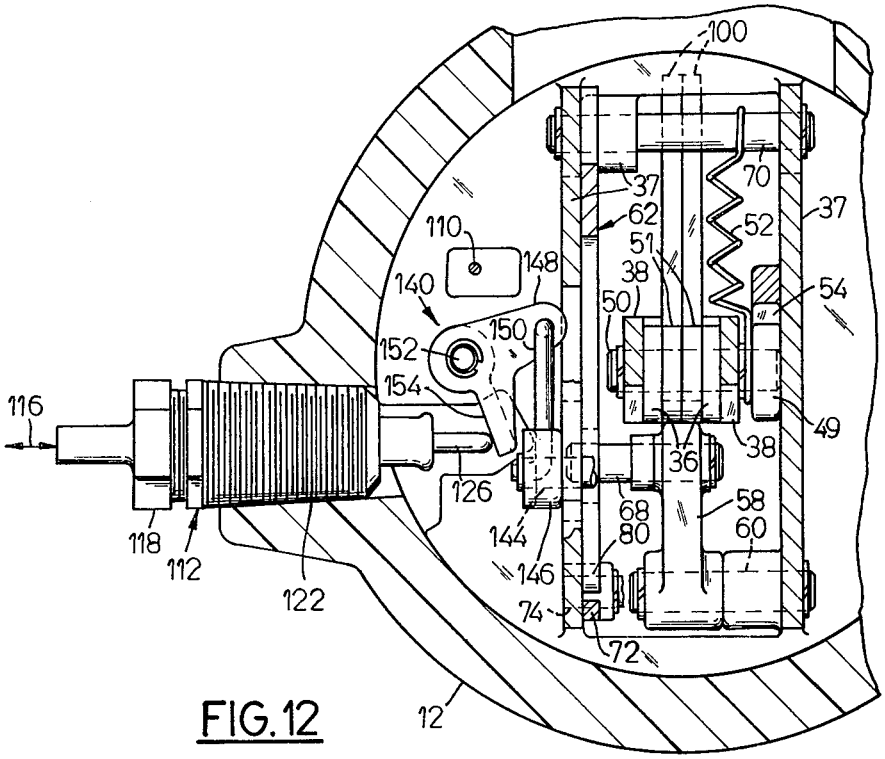
FIG. 12 is a view taken on line 12—12 of FIG. 11 showing the interphase transmitter.
Figure 11:
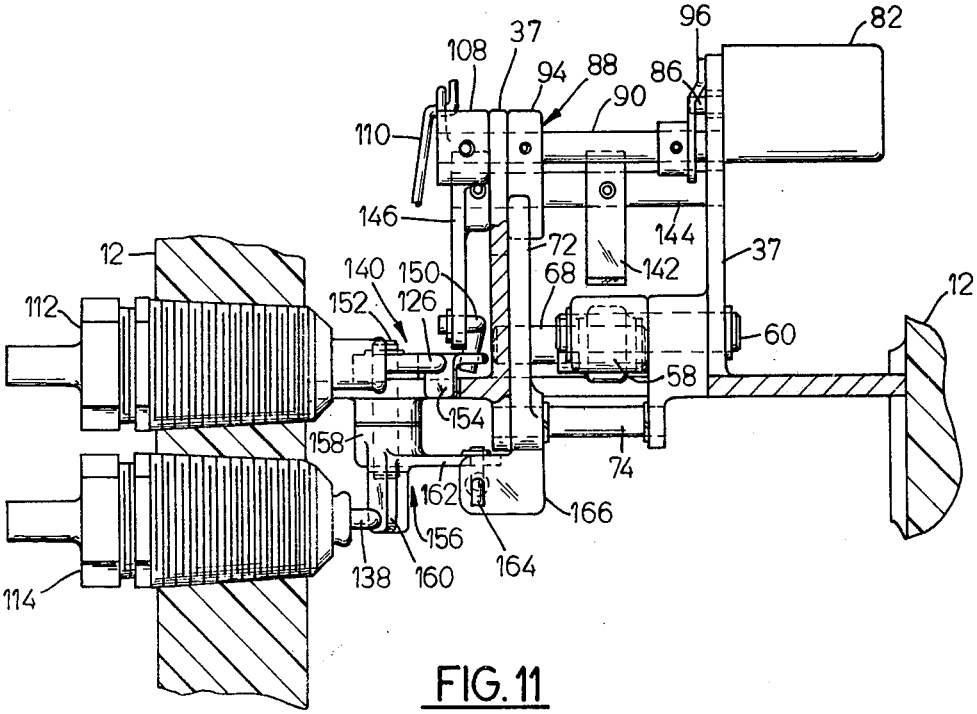
FIG. 11 is a view of the interphase trip module.

Referring to FIGS. 4, 11 and 12, the interphase transmitter 112 and interphase receiver 114 are shown mounted in the wall of the housing 12. The interphase transmitter 112 is used to provide a hydraulic pulse to an adjacent interphase receiver 114 through the hydraulic lines 116.

The interphase transmitters 112 each include a housing 118 having an axial passage 120 at the outer end and a counterbore 121 at the other end. The passage 121 is closed at the inner end by means of a flexible cover or cap 122 having an elongate extension 124. The extension 124 is reversed and forced into the passage 121 by a plunger 126. The plunger 126 is biased outwardly by means of a spring 128 provided within the passage 121. Hydraulic fluid within the passage 120 and 121 will be force out of the transmitter through the passage 120 on movement of the plunger 126 inwardly into the passage 121. The hydraulic pulse produced in the hydraulic line 116 will pressurize the corresponding interphase receiver.

The interphase receivers 114 each include a housing 130 having an axial passage 132 and a counterbore 133. The housing 130 is closed at the inner end by means of a flexible cover or cap 134 having an elongate extension 136. The elongate extension 136 is reversed and forced into the passage 133 by means of a plunger 138. On receipt of a hydraulic pulse from a transmitter 112 through the open end of the passage 132, the plunger 138 will be forced outwardly from the passage 133.

The interphase transmitters 112 as seen in FIGS. 11 and 12 are actuated by means of a linkage 140 that is mechanically actuated by a mechanical pick up arm 142 which is positioned to respond to the movement of the pivot pin 50 on collapse of the links 36 and 38. The mechanical pick up arm 142 is mounted on a pin 144 that is pivotally mounted in the frame 37. A link 146 is secured to the end of the pin 144 and is connected to a bell crank 148 by an actuating arm 150. The bell crank 148 is pivotally mounted on a pin 152 with one arm 154 positioned to engage the end of the plunger 126 for the interphase transmitter 112. As seen in FIG. 6, when the links 36 and 38 collapse, the rollers 51 on the pin 50 will engage the mechanical pick-up arm 142 rotating the pin 144. The link 146 will rotate with the rod 144 pulling the actuator arm 150 to rotate the bell crank 148. The arm 154 of the bell crank will force the plunger 126 into the interphase transmitter 112 producing a hydraulic pulse of fluid in the hydraulic line 116 to interphase receiver 114.

The pulse received by the interphase receiver 114 is transmitted to the trip lever 72 by means of a linkage assembly 156. The linkage assembly 156 includes a bell crank 158 mounted on the pivot pin 152 and having one arm 160 positioned in the path of motion of the plunger 138. The other arm 162 of the bell crank 158 is connected to a hole in the end 166 of the trip lever 72 by means of an actuating arm 164. On receipt of a hydraulic pulse from an interphase transmitter 112, the plunger 138 will be forced outwardly from the counterbore 133 into engagement with the arm 160 to rotate the bell crank 158 about the pin 152. The motion of the bell crank 158 is used to rotate the trip lever 72 to release the bell crank 62 and allow the links 36 and 38 to collapse.

The interphase trip modules 18 will be automatically reset when the corresponding fault interrupter is reset. It should be understood that each fault interrupter can be independently reset or reset simultaneously with the other fault interrupter in a three pole system. The following description will refer to the resetting action in a single interrupter.

The interphase transmitter 112 will follow the motion of the links 36 and 38 due to the bias of the spring 128. As the rollers 51 on pin 50 are pulled into line with the links 36 and 38, the bias of the spring 128 will force the pin 128 against end 154 of bell crank 148. The bell crank 148 will rotate pulling arm 150 and link 146 to rotate pin 144 so that arm 142 follows the motion of roller 51.

The interphase receiver 114 is reset by the return motion of trip lever 72 due to the bias of spring 76. As the trip lever 72 rotates, the end 166 will pull the arm 164 to rotate bell crank 158 about pin 152. The arm 160 on bell crank 158 will push pin 138 back into the housing 30.

I claim:

1. A high voltage interrupter comprising:

a circuit interrupter having a fixed contact, a movable contact and means for biasing said movable contact to an open position, a dielectric housing enclosing said interrupter and having a flexible section spaced from said movable contact, means connected to said flexible section for manually actuating and resetting said interrupter externally of said flexible section, and trip means in the space between said flexible section and said movable contact for connecting said actuating and resetting means to said movable contact, said trip means including a releasable linkage assembly for holding said movable contact in the operative position, and means responsive to a predetermined signal for tripping said releasable linkage assembly whereby said linkage assembly will collapse due to said biasing means acting on said movable contact to open said interrupter.

2. The interrupter according to claim 1 including means within said housing for indicating the position of said tripping means.

3. The interrupter according to claim 1 including means within said housing for indicating the electrical condition of said interrupter.

4. The interrupter according to claim 1 including a number of interrupters and means within the housing for each interrupter responsive to the collapse of the linkage assembly and means for connecting the responsive means to an adjacent interrupter for tripping the releasable linkage assembly in said adjacent interrupter.

5. The interrupter according to claim 1 including an insulated actuator entering the housing and being coupled to said trip means for externally actuating said trip means upon an external predetermined command.

6. The interrupter according to claim 1 including an insulated transmitter entering the housing and being coupled to said movable contact to sense externally the opening of the interrupter upon a trip operation to provide a signal for operating another device.

7. A high voltage interrupter comprising:

a circuit interrupter having a fixed contact, a movable contact and means biasing said movable contact to an open position, a trip mechanism module mounted on said circuit interrupter and including a linkage assembly for holding said movable contact in the closed position and being collapsible to allow said movable contact to move to an open position, said trip module including means for monitoring the power line and means responsive to said monitoring means to release said linkage assembly under fault current conditions to allow said linkage assembly to collapse and interrupt the circuit interrupter, a dielectric housing enclosing said circuit interrupter and trip mechanism module, said housing including a flexible dielectric interface, and means connected through said interface to said trip mechanism module for manually actuating and resetting said interrupter.

8. The high voltage interrupter according to claim 7 including means within said housing responsive to the movement of said movable contact for indicating the electrical condition of said interrupter.

9. The high voltage interrupter according to claim 7 including means within said housing connected to respond to said trip module to indicate a fault trip condition.

10. The high voltage interrupter according to claim 7 including means mounted in said housing for hydraulically sensing the collapse of said linkage assembly to actuate other equipment.

11. The high voltage interrupter according to claim 7 including an insulated actuator entering the housing and being coupled to said linkage assembly for externally actuating said linkage assembly upon an external predetermined command.

12. The high voltage interrupter according to claim 7 including an insulated transmitter entering said housing and being coupled to said movable contact to sense externally the opening of the interrupter upon a trip operation to provide a signal for operating other devices.

13. A number of high voltage circuit interrupters each including a circuit interrupter, a trip mechanism module connected to said circuit interrupter, a dielectric housing enclosing said circuit interrupter and said trip mechanism module and including a flexible interface at one end, means connected through said flexible interface for resetting said trip mechanism module and for manually opening said interrupter, and an interphase trip module in each of said circuit interrupters for hydraulically sensing the movement of said trip mechanism module, said trip modules being hydraulically interconnected whereby a hydraulic pulse produced by the movement of one trip module will be transmitted to another interrupter for tripping said another interrupter.

14. The circuit interrupter according to claim 13 wherein each of said interphase trip modules includes a hydraulic transmitter for sensing the movement of the trip mechanism module and a hydraulic receiver for tripping the trip mechanism module, each transmitter being connected to a receiver in an another interrupter.

15. The interrupter according to claim 13 wherein each of said trip mechanism modules includes a signalling device located within the dielectric housing for indicating the open or closed condition of the circuit interrupter.

16. The interrupter according to claim 13 wherein each trip mechanism module includes a fault trip signalling device within said dielectric housing for indicating a fault trip of said trip mechanism module.

17. The interrupter according to claim 13 including means within said housing for indicating whether the circuit interrupter is open or closed, means for indicating a fault trip and means in the wall of said housing for viewing the fault and open indicating means.

18. A high voltage circuit interrupter comprising:

a vacuum interrupter having a fixed contact, a movable contact and means for biasing said movable contact to an open position, a metallic housing enclosing said interrupter and having a flexible dielectric section spaced from said movable contact, a dielectric medium filling the space between said metallic housing and said circuit interrupter, means connected to said flexible section for manually actuating and resetting said interrupter externally of said housing, trip means in the space between said flexible section and said movable contact for connecting said actuating and resetting means to said movable contact, said trip means including a releasable linkage assembly for holding said movable contact in the operative position, and means responsive to a predetermined condition for releasing said linkage assembly whereby said linkage assembly will collapse due to the biasing means acting on said movable contact to open said interrupter.

19. The interrupter according to claim 18 including means within said housing for indicating the open or closed position of the movable contact.

20. The interrupter according to claim 18 including means within said housing for indicating the position of said fault current tripping means.

21. The interrupter according to claim 18 including an insulated actuator entering said housing and being coupled to said trip means for externally actuating said trip means upon an external predetermined command.

22. The interrupter according to claim 18 including an insulated transmitter entering the housing and being coupled to said trip means to sense externally the opening of said interrupter upon a trip release of said trip means to provide a signal for operating other devices.

* * * * *